US006227291B1

(12) United States Patent
Carmichael et al.

(10) Patent No.: US 6,227,291 B1
(45) Date of Patent: May 8, 2001

(54) COMPACT WELL CLEAN UP TOOL WITH MULTIFUNCTION CLEANING APPARATUS

(75) Inventors: Mark Carmichael, Aboyne; Paul Howlett, Cults, both of (GB)

(73) Assignee: Specialised Petroleum Services Limited, Aberdeenshire (GB)

( * ) Notice: Subject to any disclaimer, the term of this patent is extended or adjusted under 35 U.S.C. 154(b) by 0 days.

(21) Appl. No.: 09/256,792

(22) Filed: Feb. 24, 1999

(30) Foreign Application Priority Data

Feb. 24, 1998 (GB) ..... 9803824

(51) Int. Cl.[7] ..... E21B 37/02
(52) U.S. Cl. ..... 166/170; 166/173
(58) Field of Search ..... 166/170, 173, 166/175, 311

(56) References Cited

U.S. PATENT DOCUMENTS

| | | | | |
|---|---|---|---|---|
| 2,838,121 | * | 6/1958 | Coyle | 166/173 |
| 3,128,827 | * | 4/1964 | Kluck | 166/173 |
| 3,176,772 | * | 4/1965 | MacGregor | 166/173 |
| 4,612,986 | * | 9/1986 | Fosdick, Jr. et al. | 166/170 |
| 5,002,139 | * | 3/1991 | Haussmann et al. | 166/173 |
| 5,452,760 | | 9/1995 | Bertagnolli | 166/176 |
| 5,570,742 | * | 11/1996 | Reynolds et al. | 166/173 |
| 5,819,353 | * | 10/1998 | Armell et al. | 166/173 |

FOREIGN PATENT DOCUMENTS

| | | | |
|---|---|---|---|
| 2 195 378 | 5/1987 | (GB) | E21B/37/00 |
| 2 226 349 | 11/1989 | (GB) | E21B/37/04 |
| 2 295 632 | 8/1993 | (GB) | E21B/37/02 |
| 2 304 761 | 8/1996 | (GB) | E21B/37/02 |

* cited by examiner

*Primary Examiner*—William Neuder
(74) *Attorney, Agent, or Firm*—Clifford W. Browning; Woodard, Emhardt, Naughton, Moriarty & McNett

(57) ABSTRACT

A well cleaning tool for cleaning the inside walls of a well casing has at least two types of cleaning members; for example it may have a row of scraper blades and a row of brushes. The tool may also include one or more rotatable stabilizers that serve to maintain contact of the tool with the internal casing walls. The tool provides for obtaining the benefits of different types of cleaning members from a single trip into a well bore.

5 Claims, 1 Drawing Sheet

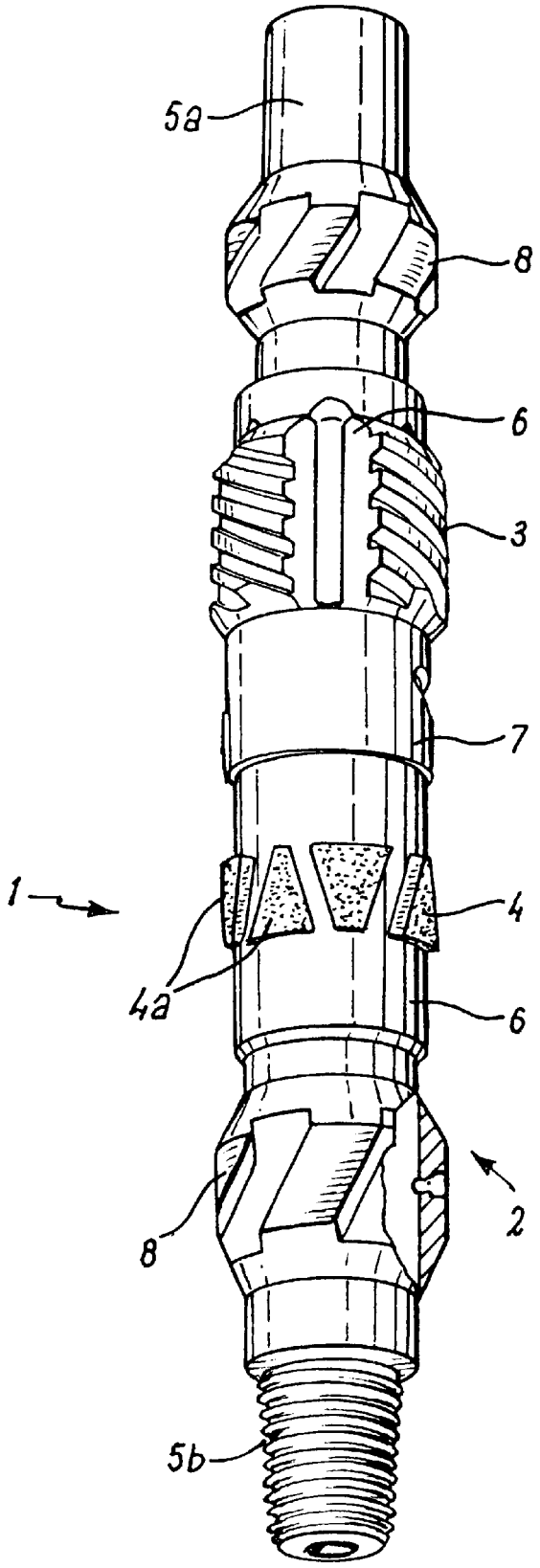
5a
8
6
3
7
1
4
4a
6
2
8
5b

COMPACT WELL CLEAN UP TOOL WITH MULTIFUNCTION CLEANING APPARATUS

BACKGROUND OF THE INVENTION

This invention relates to tools used for the drilling of oil and gas. The invention particularly relates to a well clean up tool and to its use.

It is considered desirable when drilling for oil or gas to maintain a clean interior in the casing or liner of the well. For this purpose, well cleaning apparatus is well known and comes in a variety of different forms. One such type of well cleaning apparatus is a casing scraper. This type of tool typically incorporates steel casing scraper blades that scrape the inside of the casing or tubing in the well. The steel blades provided with casing scrapers usually are designed to clean the casing interior of relatively large particles or debris, such as lumps of cement, rocks or congealed mud and so on.

A second type of well cleaning apparatus known in the art may be more accurately likened to a brush and incorporates cleaning pads with protruding bristles. Brushing tools are generally used to clean well casings, tubing and the like of smaller debris and or particles than that of scraper tools. Brushing tools may be used to remove oxidation lumps, scale, paraffin and burrs for example.

As the brushing tools offer a more finishing cleaning operation than the casing scrapers, it would be desirable to run a brushing tool after a scraper tool, but for the cost of running two tools. Often the time and associated coat of hiring and running two cleanup tools is prohibitive. Having to withdraw the scraper from the well, replace it in the drill string with a brushing tool and then run the cleanup operation again is frequently considered difficult to justify. Also, simultaneously running both a scraper tool and a brushing tool in the same string means that one or both of the tools can not properly access the desired areas to be cleaned, such as near to the liner top; the combined tools not being sufficiently compact.

An object of the present invention is to provide an improved well cleanup tool that combines at least two types of cleaning members. For example a tool in accordance with the present invention may have both scraping and brushing cleaning members.

A further object of the present invention is to provide a compact well clean up tool with multifunctional cleaning members.

BRIEF SUMMARY OF THE INVENTION

According to the present invention there is provided a well clean up tool for cleaning the inside walls of a well casing, the tool comprising at least two types of cleaning members.

The tool may comprise scraper blades and brushes. Alternatively it may comprise a scouring pad and blades or brushes.

Preferably the tool comprises a supporting structure upon which is supported a row of first cleaning members axially spaced from a row of alternative cleaning members. The cleaning members may provide full circular or 360 degree contact with the casing wall at each row.

The supporting structure may comprise a generally elongated body member attachable to a work string or the like. It may include one or more cleaning pads supporting the cleaning members.

Means may be provided for rendering one form of cleaning members inoperable during use.

Preferably the tool further includes one or more stabilizers that serve to maintain contact of the tool with the internal casing walls. The stabilizers may be provided as sleeves that are free to rotate relative to the supporting structure.

BRIEF DESCRIPTION OF THE DRAWINGS

In order to provide a better understanding of the invention, an embodiment thereof will now be described, by way of example only, and with reference to the accompanying Figures, in which the single Figure shows a compact tool having two alternative types of cleaning members.

DETAILED DESCRIPTION OF THE DRAWINGS

In the Figure a tool is generally depicted at 1. The tool 1 has an elongate cylindrical body member 2 upon which is located two rows of cleaning members 3,4.

The upper row 3 of cleaning members are provided as steel scraper blades formed as helical ribs. The lower row 4 of cleaning members are provided as brushes having radially protruding bristles thereon.

At each end of the body member 2 is provided connection means 5*a*, 5*b* for connection of the tool 1 in a work string (not shown).

The cleaning members 3,4 are supported on pads 6 which are retained on the body member 2 by a retaining ring 7.

In the example embodiment shown in the Figure hereto, the brushes are formed in substantially triangular sections. The triangular sections are spaced circumferentially around the pad 6 with the base of the triangular sections being alternated sequentially around the circumference between toward the top and bottom of the tool 1.

The arrangement of the sections 4*a* allows for full 360 degree coverage of the brushes around the tool, while still providing by-pass paths between each brush section.

Rotatable stabilisers 8 are provided as sleeves mounted on the tool that reduce any reaction torque that might be applied to the string on which the tool is attached.

In an alternative embodiment, not shown, cleaning members in the form of casing scraper blades could be arranged in a similar manner to the brush sections shown and described herein.

In a typical design the cleaning members would be biased outwardly to encourage their contact on the casing wall. The outer diameter of each row of cleaning members would be maintained at a substantially equal dimension.

It should be noted herein that the present invention is not limited to the number of rows of cleaning members incorporated on the tool. Neither should any particular type of cleaning member be considered necessary in order to comply with the invention.

Rather, the present invention allows a plurality of alternative type cleaning members to be incorporated on a single tool body. This has the advantage of providing for more than one type of cleaning action to be performed on a casing wall or the like at any one time.

Furthermore, a tool incorporating the invention may be more effective than well cleanup tools heretofore known as the provision of multi-type or multi-function cleaning members renders the tool more versatile in its ability to clean a casing of a wider variety of debris or the like.

Also, in the event that one type of cleaning member wears or becomes inadvertently damaged, the present invention provides a fall back position in that an alternative cleaning member is still available.

In an alternative embodiment, not shown, the tool may be designed to allow for the retraction or disengagement of one of the types of cleaning members which may be considered unsuitable or undesirable in a particular application.

In an alternative embodiment, the tool may have cleaning pads, such as those illustrated at 6 in the Figure, but which are also adapted to receive various kinds of cleaning members. The cleaning members could be easily detachable from the pads and be replaced with an alternative type of cleaning member to suit a particular job requirement. Thus, an operator could replace the brush sections with scouring pads, for example, when using a tool of this suggested design. Alternatively, one type of cleaning member could be removed or repositioned to render it inoperable on any particular run.

It would also be possible for the different types of cleaning members to be provided on the same row, that is at approximately the same axial position on the tool.

Further modifications and improvements may be incorporated without departing from the scope of the invention herein intended.

What is claimed is:

1. A well cleaning tool for cleaning the inside walls of a well casing, the tool comprising at least two types of cleaning members providing for more than one type of cleaning action to be performed at any one time, wherein the types of cleaning members include scraper blades and brushes, and the tool includes one or more stabilisers that serve to maintain contact of the tool with internal casing walls, wherein the stabilisers are provided as sleeves that are free to rotate relative to the tool.

2. A well cleaning tool as claimed in claim 1 comprising a supporting structure upon which is supported a row of first cleaning members axially spaced from a row of alternative cleaning members.

3. A well cleaning tool as claimed in claim 1 wherein at least one of the cleaning members provide full circular or 360 degree contact with the casing wall.

4. A well cleaning tool as claimed in claim 2 wherein the supporting structure comprises a generally elongated body member attachable to a work string.

5. A well cleaning tool as claimed in claim 1 including one or more cleaning pads supporting the cleaning members.

* * * * *